US008684857B2

(12) United States Patent
Buckley et al.

(10) Patent No.: US 8,684,857 B2
(45) Date of Patent: Apr. 1, 2014

(54) TEN PIN BOWLING METHOD AND APPARATUS

(76) Inventors: David Leonard Buckley, Nelly Bay (AU); Allan Paton, Nelly Bay (AU)

( * ) Notice: Subject to any disclaimer, the term of this patent is extended or adjusted under 35 U.S.C. 154(b) by 0 days.

(21) Appl. No.: 13/514,845

(22) PCT Filed: Dec. 10, 2010

(86) PCT No.: PCT/AU2010/001667

§ 371 (c)(1),
(2), (4) Date: Jun. 8, 2012

(87) PCT Pub. No.: WO2011/069206

PCT Pub. Date: Jun. 16, 2011

(65) Prior Publication Data

US 2012/0252592 A1 Oct. 4, 2012

(30) Foreign Application Priority Data

Dec. 10, 2009 (AU) ..... 2009906021
Jul. 27, 2010 (AU) ..... 2010903340

(51) Int. Cl.
*A63D 5/00* (2006.01)

(52) U.S. Cl.
USPC ..... 473/107; 273/129 V

(58) Field of Classification Search
USPC ..... 473/107; 273/129 R, 129 M, 129 V
See application file for complete search history.

(56) References Cited

U.S. PATENT DOCUMENTS

| | | | | |
|---|---|---|---|---|
| 667,026 | A * | 1/1901 | Lubitz | 124/26 |
| 2,263,602 | A * | 11/1941 | Whittle | 124/78 |
| 3,236,223 | A * | 2/1966 | Rockwood | 124/61 |
| 4,470,598 | A | 9/1984 | Steele et al. | |
| 5,271,619 | A | 12/1993 | Caminiti | |
| 6,379,257 | B1 * | 4/2002 | Skleba et al. | 473/107 |

FOREIGN PATENT DOCUMENTS

| | | |
|---|---|---|
| GB | 2430892 | 4/2007 |
| WO | 2009/000026 | 12/2008 |

* cited by examiner

*Primary Examiner* — William Pierce
(74) *Attorney, Agent, or Firm* — Shoemaker and Mattare

(57) ABSTRACT

A method for bowling a ball typically in ten pin bowling using apparatus (10) in which a ball (15) is supported to movable support means typically a roller (23) which is rotatably driven by a motor (26) whilst the ball is restrained in a substantially fixed position with the apparatus (10) including a stop (29) which may be actuated to release the rotating ball (15) to allow said ball to travel in a desired direction of travel along an elongated guide member or barrel (11).

20 Claims, 2 Drawing Sheets

TEN PIN BOWLING METHOD AND APPARATUS

TECHNICAL FIELD

This invention relates to the field of tenpin bowling and in particular to a method and means for bowling balls in ten pin bowling designed primarily but not exclusively for use by persons who are normally unable to lift and/or bowl ten pin bowling balls. The method and means of the invention may also be applied to bowling of other balls and thus the reference to ten pin bowling balls throughout the specification balls of all types which can be bowled.

BACKGROUND ART

Tenpin bowling is one of the world's greatest participatory activities, with player's ages ranging from 2 years of age to 90 plus. A tenpin bowling ball is a standard size (8.5 inches in diameter) but can range in weight from 6 to 16 lbs. The size and weight of the bowling ball presents a substantial challenge to the very young, infirm, aged and the disabled. As a consequence, a number of aids have been developed, including balls with handles, ramps, and various pushing devices to assist these players.

Over recent years there has also been a trend towards novelty bowling to attract social players to bowling as a purely social activity. This has led to the developments such as gutter bumpers, virtual bowling, light and media displays and a remote controlled bowling ball.

It would be desirable however if a method and means were available which enabled persons normally unable to lift or manipulate a ten pin bowling ball to easily bowl a ball

SUMMARY OF THE INVENTION

The present invention thus provides in a first preferred aspect, a method of bowling a ball, said method comprising the steps rotating a said ball whilst said ball restrained in a substantially fixed position and releasing said ball to allow said ball to travel in a desired direction of travel Typically the method is used for ten pin bowling and the ball when released travels down a bowling lane. Typically the ball when in the fixed position is rotated about a substantially horizontal axis.

The present invention in a further preferred aspect provides ball bowling apparatus, said apparatus including movable support means for supporting a said ball, means for driving said movable support means to cause rotation of said ball, and means for releasing said ball from said support means to allow said ball to travel in a desired direction of travel.

Preferably the movable support means comprises a rotatable roller adapted to be driven directly or indirectly by a drive motor. Preferably elongated guide means are provided to guide movement of the ball. The guide means may be in the form of a hollow elongated member or barrel.

Preferably the apparatus includes a loading breech for moving a ball onto the movable support means. The breech may be slidably movable between a retracted open loading position for loading of a ball and a closed position in which the ball is moved onto the movable support means. Preferably the breech defines a cradle for supporting the ball for loading onto the movable support means.

Preferably the breech includes means which provided supplementary support to the ball when supported on the movable support means. Suitably the supplementary support means comprise one or more further rollers which may locate the rear of the ball. Preferably the one or more further rollers comprise spaced rollers supported for rotation about a substantially horizontal axis.

Preferably means are provided to sense movement of the breech into the closed position to enable drive to be supplied by a drive motor to the movable support means. The drive motor typically comprises an electric motor and the sensing means suitably comprises a switch which is engaged by the breech when moved to the closed position.

Preferably also means are provided which sense whether a ball is in the breech. Preferably the ball sensing means comprises optical sensing means.

Preferably releasable stop or restraining means are provided in the path of movement of the ball. The releasable stop means is preferably releasable to allow release of a rotating ball. The releasable stop means may be released by operation of a release arm. Preferably the stop means comprises a stop member which is normally in the path of movement of the ball. Preferably the stop member is rotatable or pivotal about a substantially vertical axis out of the path of movement of the ball. Preferably operation of the release arm permits the stop member to rotate typically to a substantially horizontal position to allow release of the ball for travel along the guide member or barrel.

As an alternative or additionally, the ball may be released by stopping the drive motor for example by braking the drive motor and/or removing power from the drive motor.

BRIEF DESCRIPTION OF THE DRAWINGS

Reference will now be made to the accompanying drawings which illustrate a preferred embodiment of the invention and wherein.

DETAILED DESCRIPTION OF THE PREFERRED EMBODIMENT

Figure 1:
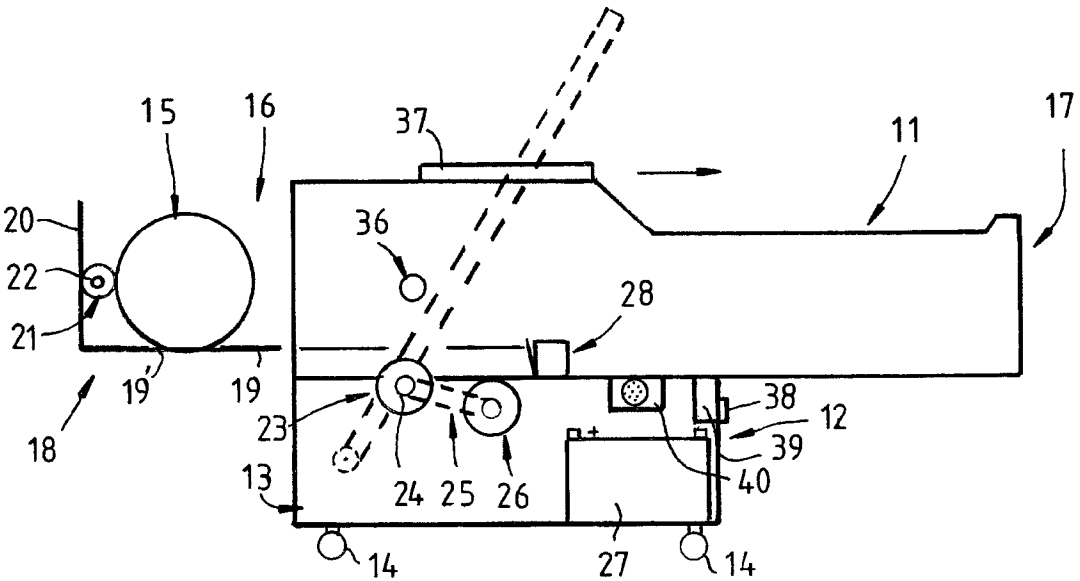
FIG. 1 illustrates schematically in side view ten pin bowling apparatus according to the invention with the ball positioned for loading into the apparatus.

Referring firstly to FIG. 1, there is illustrate ten pin bowling apparatus 10 according to an embodiment of the present invention including an elongated hollow guide member 11 which is supported on a mobile carriage 12 comprising a carriage body 13 mounted on wheels and/or castors or similar 14. The hollow guide member 11 has internal dimensions such as to allow a ten pin bowling ball 15 to travel freely therealong from a loading end 16 of the guide member 11 to an exit end 17 thereof. The guide member 11 comprises a barrel-like member.

Figure 2:
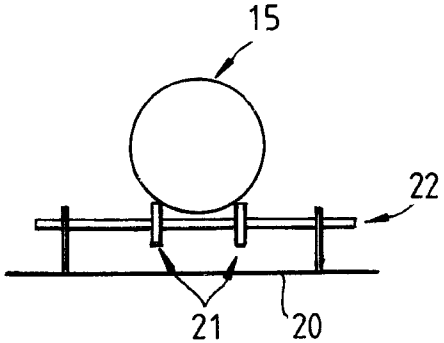
FIG. 2 is a schematic top view showing the manner in which the ball is supported before loading into the apparatus and prior to bowling.

A breech 18 defining a ball cradle is provided at the loading end 16 of the guide member 11. The breech 18 is slidably mounted to the guide member 11 or body 13 so as to be slidable between the retracted position shown in FIG. 1 to a load position (shown in FIG. 3). The breech cradle has a bottom wall member 19 having an opening 19' therein in which the ball 15 may seat whilst an end wall member or door 20 of the breech 18 carries spaced apart rollers 21 supported for free rotation on a transversely extending shaft 22. The ball 15 seats in the breech cradle prior to entry into the guide member 11 and when supported on the cradle, the ball 15 can lie against the spaced rollers 21 as shown in FIG. 2

Provided within the carriage body 13 is a central drive roller 23 which is aligned with the longitudinally axis of the guide member 11 and which is supported for rotation about a substantially horizontal axis on a bearing mounted axle 24 extending substantially at right angles to the guide member 11. The axle 24 is coupled through a suitable transmission such as chain sprocket transmission 25 to an electric motor 26. Power supply for the motor 26 is provided by a battery 27 within the carriage body 13.

A microswitch 28 is provided within and on one side of the guide member 11 in the path of movement of the breech 18, the microswitch 28 controlling supply of power from the battery 27 to the motor 26.

Figure 3:
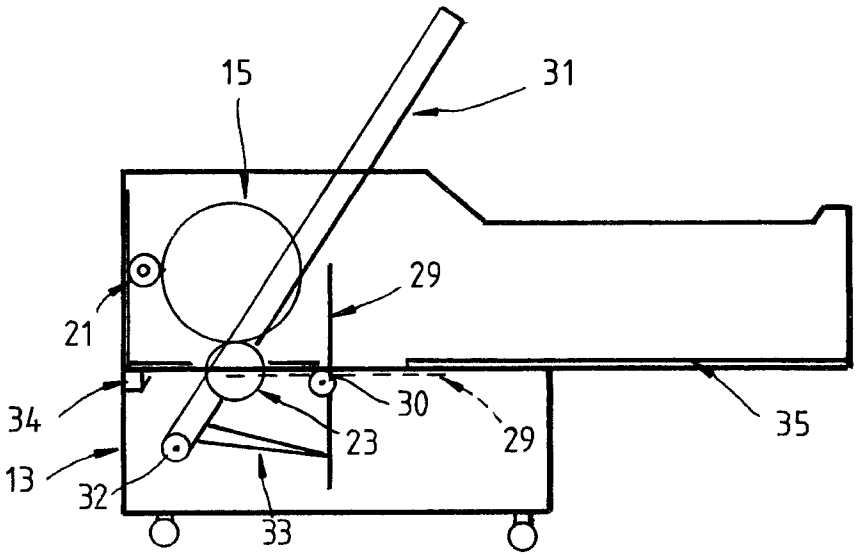
FIG. 3 illustrates schematically in side view the apparatus loaded with the ball and prior to bowling.

A normally upright stop arm 29 (see FIG. 3) normally prevents the ball 15 from rolling through the guide member 11, the stop arm 29 being mounted to the carriage body 13 for pivotal rotation about an axis 30 and projecting upwardly into the guide member 11 to be in the path of movement of the ball 15. A firing lever 31 also pivotally mounted at 32 for movement about a horizontal axis. A link arm or stop member 33 connected to the lever 31 normally cooperates with an extension or lever of the stop arm to hold the stop arm 29 in position as shown in FIG. 3 so that the ball 15 cannot move down the guide member 11. Forward movement of the lever 31 will disengage the link arm or stop member 33 from the stop arm 29 or extension thereof which will allows the stop arm 29 to rotate clockwise and lie substantially flat along the base of the guide member 11 as shown in dotted outline in FIG. 3 which will allow the ball 15 to move down the guide member 11. A further microswitch 34 is provided in the carriage body 13 in the path of movement of the firing lever 31.

Placed along the bottom of the guide member 11 is a friction pad 35. This pad 35 can be made of cloth rubber, foam, plastic or other suitable material that will absorb any lane conditioner carried into the mechanism on the ball 15, and provide friction for the ball 15 to drive itself out of the guide member 11.

An optical switch 36 (see FIG. 2) is provided on the side of the guide member 11 to sense the presence of a ball 15 on the breech 18 when the breech 18 is slid into the guide member 11. The switch 36 is in series with the microswitch 28 and microswitch 34.

In use, the apparatus 10 is moved into the normal position of bowling in ten pin bowling and the player aligns the guide member 11 as desired with the bowling lane and then slides the breech 18 open to the position of FIG. 1. This disengages the microswitch 28 and prevents power from being supplied to the drive motor 26 from the battery 27. This is a safety mechanism to ensure the safety of the user.

When the breech 18 is open, the player places the bowling ball 15 onto the breech cradle and pushes or slides the breech 18 closed. In this movement, the ball 15 is lifted up onto the drive wheel 23 and rests on and is supported on its rear side by the rollers 21. The position of the ball 15 can be adjusted backwards or forwards by moving the door rollers 21 closer or further apart along the shaft 22 as desired. In the ball loaded position the stop arm 29 prevents the ball 15 from rolling through the guide member 11.

As the breech 18 closes, the microswitch 28 is engaged by the breech 18 and closes as does the ball activated optical switch 36. When both switches 28 and 36 are closed, the power circuit is completed such the power is supplied to the drive motor 26 from the battery 27. This causes rotation of the drive wheel 23 in an anticlockwise direction and consequently causes the bowling ball 15 to be rotated clockwise being supported on the drive wheel 23 and by the end rollers 21. Once the ball 15 is at maximum rotation, it will stay in position rotating as long as the wheel 23 rotates.

To release the ball 15, the player then operates the firing lever 31 by pivoting it or rotating it clockwise which engages microswitch 34 and cuts power supply from the battery 27 to the drive motor 26. Further, as the firing lever 31 is moved forward, the link arm or stop member 33 disengages from the stop arm lever 29 and allows the stop arm 29 to rotate. The stop arm 29 can then rotate to a flat position parallel to the base of the guide member 11 which will allow the rotating ball 15 to drive itself forward through the guide member 11 and onto the bowling lane.

With power removed from the drive motor 26, the drive wheel 23 stops, the stop arm 29 is cleared by the ball 15 and as the firing lever 31 is returned to the starting position, the link arm or stop member 33 again engages the stop arm 29 and rotates the stop arm 29 back into the guard position of FIG. 3. As the firing lever 31 is disengaged from microswitch 34, power is allowed to be supplied through the circuit once microswitches 28 and 36 operate. With the slidable breech 18 closed, and with the ball 15 no longer in the breech cradle, the optical switch 36 will prevent power supply to the motor 26 from the battery 27 as a ball 15 will not be detected by the switch 36. Thus the motor 26 cannot run without a ball 15 in the breech cradle and the user can slide open the breech 18 in safety.

The stop arm 29 mechanism may be adapted to also push the ball 15 from the breech without stopping the motor 26. Further other alternative methods of ejecting the ball 15 such as rams, hinged pusher arms, solenoid activated arms and the like would be equally feasible and are encompassed within the scope of this application.

In the preferred form, the drive mechanism consists of a wheel driven by a chain or other transmission from the drive motor 26. Alternatively, the roller may be directly driven by the motor 26. Further the drive roller 23 may be replaced by belts, two or more rollers chains or other components which will effect rotation of the ball typically about a horizontal axis whilst is remains in a fixed position.

The speed of the ball 15 can be adjusted by including a speed adjusting circuit with the drive motor 26 so that the speed of the motor can be controlled and set at any desirable level.

The apparatus 10 may also include a laser transmitter unit 37 (see FIG. 1) which may be mounted on the guide member or barrel 11 which emits a laser beam which can be sighted on the pins for aiming of the guide member or barrel 11 towards the pins.

The front of the carriage 12 as also show in FIG. 1 may also be provided with a proximity sensor 38 which will sense the presence of persons in the front of the guide member or barrel 11. The proximity sensor 38 is connected in an alarm circuit 39 with includes an audible alarm 40 such as a siren which will be sounded upon the presence of a person being sensed. Persons operating the apparatus 10 will thus be warned as will the person whose presence is sensed so that appropriate action can be taken.

The alarm circuit 39 is also connected to the laser transmitting unit 37 and will remove power supply from the laser transmitting unit 37 when the presence of a person is sensed by the sensor 38.

The alarm circuit 39 is also connected in the supply circuit to the motor 26 such that when the presence of a person is sensed by the sensor 36, power supply to the motor 26 is removed. If power supply was not removed from the motor in these circumstances, release of the stop arm 29 will cause a ball 15 to be released creating a risk to persons in front of the guide member 11. If however power is removed from the motor 26, the momentum of the ball 15 will drive the support roller 23 until both the ball 15 and roller 23 rotate to a stop. When the risk is removed, the apparatus 10 and the firing lever 31 can be reset.

In the apparatus of the present invention, the ball 15 remains in a substantially fixed position relative to the guide member 11 as the mechanism rotates the ball from rest. The ball 15 is allowed to reach maximum rotation for any length of time the bowler desires. Further the ball 15 can be discharged by stopping the motor and allowing the rotation of the bowling ball 15 to move it out of the guide member.

It should be noted that reference to the prior art herein is not to be taken as an acknowledgement that such prior art constitutes common general knowledge in the art.

The terms "comprising" or "comprises" as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as herein described.

The invention claimed is:

1. Ball bowling apparatus for bowling a ball, said apparatus comprising a drive roller upon which a said ball may seat, said drive roller being supported for rotation about a substantially horizontal axis, means for engaging the rear side of a said ball to support a said ball in a substantially fixed position seated on and located substantially above said drive roller, means for driving said drive roller to cause rotation of said ball whilst said ball is supported in said substantially fixed position on said drive roller, and means for stopping or braking said drive motor and thereby said drive roller whereby to allow the rotation of said ball imparted by said drive roller to cause said ball to move from said drive roller and travel in a desired direction of travel.

2. Ball bowling apparatus as claimed in claim 1 and including elongated guide means for guiding movement of the ball, said guide means extending forward from said drive roller relative to said direction of travel of said ball to receive a ball moving from said drive roller.

3. Ball bowling apparatus as claimed in claim 2 wherein said guide means comprises a hollow elongated member or barrel.

4. Ball bowling apparatus as claimed in claim 2 wherein said elongated guide means is provided with a friction pad for increasing friction with a said ball moving from said drive roller along said guide means.

5. Ball bowling apparatus as claimed in claim 1, further comprising a loading breech for moving a ball onto the drive roller, said breech being mounted for sliding movement between a retracted open loading position for receipt of a ball and a closed position in which the ball is moved onto the drive roller.

6. Ball bowling apparatus as claimed in claim 5 wherein said breech defines a cradle, said cradle having an opening in which a said ball may seat and be supported for loading onto the drive roller.

7. Ball bowling apparatus as claimed in claim 6 wherein said breech includes an upright end wall carrying said ball engaging means.

8. Ball bowling apparatus as claimed in claim 7 wherein said ball engaging means comprise one or more rollers for engaging and locating the rear of the ball, said one or more rollers being supported for free rotation about a substantially horizontal axis.

9. Ball bowling apparatus as claimed in claim 5 and including means for sensing movement of the breech into the closed position, said sensing means preventing operation of said drive means unless said breech is in said closed position.

10. Ball bowling apparatus as claimed in claim 1 and including releasable stop means in the path of movement of the ball, said releasable stop means normally preventing movement of said ball in said desired direction of travel but being releasable to allow a rotating ball to move in said desired direction of travel after moving from said drive roller.

11. Ball bowling apparatus as claimed in claim 10 wherein said releasable stop means comprising a stop member which is mounted for rotation about a substantially horizontal axis, and there being provided a release arm which normally maintains said stop member in an upright position but which is operable to release said stop member to allow said stop member to rotate to a substantially horizontal position out of the path of movement of the ball.

12. Ball bowling apparatus as claimed in claim 1 wherein said drive means comprises a drive motor, said roller being coupled directly or indirectly to said drive motor such that operation of said drive motor causes said roller to rotate in an anti-clockwise direction so as to impart a clockwise rotation in said ball when said ball is seated on said roller.

13. Ball bowling apparatus for bowling a ball onto a bowling lane, said apparatus comprising a drive roller upon which a ball may seat, said drive roller being mounted for rotation about a substantially horizontal axis, a pair of spaced apart freely rotatable rollers rearwardly of said drive roller, said rollers of said pair being mounted for rotation about a substantially horizontal axis and being adapted to engage and support the rear side of a said ball for locating said ball in a substantially fixed position seated on and located substantially above said drive roller, a drive motor coupled to said drive roller for rotatably driving said drive roller so as to impart rotation to said ball about a substantially horizontal axis whilst said ball is located in said substantially fixed position on said drive roller, and means for stopping or braking said drive motor and thereby said drive rollerto allow the rotation of said ball imparted by said drive roller to cause said ball to move from said drive roller and travel along said bowling lane.

14. Ball bowling apparatus as claimed in claim 13 and including a loading breech having a cradle for receiving said ball, said loading breech further carrying said pair of spaced apart rollers for engaging the rear side of said ball, said loading breech being slidably movable between a retracted open loading position for receiving a ball and a closed position in which the ball seats on the drive roller and is supported by said spaced apart rollers.

15. Ball bowling apparatus as claimed in claim 13 and including an elongated guide member extending from said drive roller, said elongated guide member having a longitudinal axis and wherein said drive roller comprises a central roller aligned with said longitudinal axis.

16. Ball bowling apparatus for bowling a ball onto a bowling lane, said apparatus comprising an elongated guide member, said guide member having a longitudinal axis, a ball loading end at one end of said elongated guide member and a ball exit end at the opposite end of said elongated guide member, movable ball support means at said ball loading end for supporting and imparting a rotation to a said ball about a horizontal axis, means for engaging the rear side of a said ball to support said ball in a substantially fixed position seated on and located substantially above said ball support means, a drive motor for driving said ball support means so as to impart rotation to a said ball about a horizontal axis whilst said ball is located in said substantially fixed position on said ball support means, and means for stopping or braking said drive motor and thereby said ball support means to allow the rotation of said ball imparted by said ball support means to cause said ball to move from said ball support means onto said elongated guide member and travel along said guide member to exit from said exit end thereof onto said bowling lane.

17. Ball bowling apparatus as claimed in claim 16 wherein said ball engaging means comprises one or more rollers for engaging and supporting the rear side of the ball, said one or more rollers being supported for free rotation about a substantially horizontal axis.

18. Ball bowling apparatus as claimed in claim 17 and including a loading breech having a cradle for receiving said ball, said loading breech carrying said one or more rollers, said loading breech being slidably movable between a retracted open loading position for receipt of a ball and a closed position in which the ball is moved to a position in which it seats on said ball support means and is supported by said one or more rollers.

19. Ball bowling apparatus as claimed in claim 16 wherein said ball support means comprises a drive roller mounted for rotation about a substantially horizontal axis.

20. Ball bowling apparatus as claimed in claim 19 wherein said drive roller comprises a central roller aligned with said longitudinal axis of said guide member.

* * * * *